US010039177B2

(12) United States Patent
Czap et al.

(10) Patent No.: US 10,039,177 B2
(45) Date of Patent: Jul. 31, 2018

(54) SOURCE HOLLOW BODY AND EUV PLASMA LIGHT SOURCE COMPRISING SUCH A SOURCE HOLLOW BODY

(71) Applicant: Carl Zeiss SMT GmbH, Oberkochen (DE)

(72) Inventors: Almut Czap, Aalen (DE); Sebastian Schall, Oberkochen (DE)

(73) Assignee: Carl Zeiss SMT GmbH, Oberkochen (DE)

( * ) Notice: Subject to any disclaimer, the term of this patent is extended or adjusted under 35 U.S.C. 154(b) by 0 days.

(21) Appl. No.: 15/659,920

(22) Filed: Jul. 26, 2017

(65) Prior Publication Data

US 2018/0035525 A1 Feb. 1, 2018

(30) Foreign Application Priority Data

Jul. 27, 2016 (DE) ..... 10 2016 213 830

(51) Int. Cl.
*H05H 1/24* (2006.01)

(52) U.S. Cl.
CPC ..... *H05H 1/24* (2013.01)

(58) Field of Classification Search
CPC ..... H01J 37/32504; H01J 37/32559; H01J 37/32596; H01J 2237/3365; H01L 21/67207; H01L 21/76832; H01L 21/76846; H05G 2/001; H05G 2/005; H05G 2/008; H05H 1/24; H05H 2001/3436; G03F 7/70033; G03F 7/70008; C23C 14/046
See application file for complete search history.

(56) References Cited

U.S. PATENT DOCUMENTS

| | | | | |
|---|---|---|---|---|
| 6,396,214 | B1 * | 5/2002 | Grosse | H01J 37/32357 315/111.21 |
| 7,926,446 | B2 * | 4/2011 | Behle | B08B 9/426 118/719 |
| 8,399,861 | B2 * | 3/2013 | Manini | G03F 7/70916 250/492.1 |
| 2003/0147499 | A1 | 8/2003 | Kondo | |
| 2009/0272919 | A1 | 11/2009 | Abe et al. | |
| 2011/0089834 | A1 | 4/2011 | McGeoch | |
| 2011/0240890 | A1 | 10/2011 | Govindaraju et al. | |
| 2014/0117258 | A1 | 5/2014 | Smith | |
| 2015/0318151 | A1 * | 11/2015 | Krassnitzer | H01J 37/3233 427/569 |

OTHER PUBLICATIONS

German Examination Report for German Application No. DE 10 2016 213 830.8 dated Mar. 31, 2017.

Partlow, et al., "Extreme-ultraviolet light source development to enable pre-production mask inspection", *Journal of Micro/Nanolithography, MEMS, and MOEMS*, vol. 11, No. 2, pp. 021105-1-021105-10 (Apr.-Jun. 2012).

* cited by examiner

*Primary Examiner* — Haissa Philogene
(74) *Attorney, Agent, or Firm* — Fish & Richardson P.C.

(57) ABSTRACT

A source hollow body serves for predefining a plasma chamber for a section of a source plasma of an EUV plasma light source. The hollow body has at least one chamber wall that delimits the plasma chamber. The chamber wall has a multilayer construction. This results in a source hollow body that improves the practical usability of an EUV plasma light source equipped with the source hollow body.

20 Claims, 2 Drawing Sheets

SOURCE HOLLOW BODY AND EUV PLASMA LIGHT SOURCE COMPRISING SUCH A SOURCE HOLLOW BODY

CROSS-REFERENCE TO RELATED APPLICATION

This application claims priority to German patent application DE 10 2016 213 830.8, filed on Jul. 27, 2016. The entire content of the above application is hereby incorporated by reference.

TECHNICAL FIELD

The invention relates to a source hollow body for predefining a plasma chamber for a section of a source plasma of an EUV plasma light source.

BACKGROUND

Such a source hollow body is known from the technical article "Extreme-ultraviolet light source development to enable pre-production mask inspection" by M. J. Partlow et al., J. Micro/Nanolith. MEMS MOEMS 11(2), 021105 (April-June 2012). US 2011/0089834 A1 describes a further embodiment of an EUV plasma light source. US 2003/0147499 A1 describes a vacuum chamber for an X-ray generator. Further EUV plasma light sources are known from US 2009/0272919 A1, US 2014/0117258 A1 and US 2011/0240890 A1.

SUMMARY

The present invention can improve the practical usability of an EUV plasma light source equipped with such a source hollow body.

In a first general aspect, a source hollow body for predefining a plasma chamber for a section of a source plasma of an EUV plasma light source is provided. The hollow body includes at least one chamber wall that delimits the plasma chamber, in which the chamber wall includes a multilayer construction. The multilayer construction of the chamber wall includes a main body and a plastic layer applied at least in sections on an inner wall of the main body facing the plasma chamber.

In a second general aspect, a source hollow body for predefining a plasma chamber for a section of a source plasma of an EUV plasma light source is provided. The hollow body includes at least one chamber wall that delimits the plasma chamber, in which the chamber wall includes a multilayer construction. The multilayer construction of the chamber wall includes a main body, and a plastic moulding insert arranged at least in sections on an inner wall of the main body facing the plasma chamber, and including at least one insert inner wall which serves as a lining of the chamber wall of the hollow body delimiting the plasma chamber and, for its part, delimits the plasma chamber.

It has been recognized according to the invention that handleability of known EUV plasma light sources is limited on account of debris formation, which is attributable in particular to sputtering effects at the source hollow body. The multilayer construction makes it possible to choose a main body material of the source hollow body in accordance with the basic requirements made of the hollow body on account of plasma generating operation, and at the same time to ensure by use of a coating or an insert that undesired effects of the main body material that impair the handleability of the plasma light source, in particular undesired sputtering effects, are avoided or reduced by the use of the main body coating or by the use of the insert. Debris formation, in particular, can be reduced or avoided. A sputtering rate, too, can be reduced or avoided. A lifetime of the source hollow body is increased in this way. The risk that the hollow body can be separated from attachment components with undesired difficulty can likewise be reduced. Requirements made of a cleaning method for the plasma chamber of the light source are also reduced if such a cleaning method is still necessary. The source hollow body, for its part, can be part of a core main body of an EUV plasma light source. Alternatively, the source hollow body can be embodied as a component that is separate from such a core main body of the light source and is mechanically connected thereto.

According to a third general aspect of the invention, the multilayer construction of the chamber wall has a main body and a plastic layer applied at least in sections on an inner wall of the main body facing the plasma chamber. Such a chamber wall having a main body and a plastic layer has proved to be particularly suitable. The main body can be a ceramic main body or a metal main body. One example of the ceramic of the main body is SiC. As an alternative to SiC, the ceramic main body can be constructed from some other ceramic material, for example from an oxide ceramic or from a technical ceramic in the form of a boride, nitride or carbide. One example of the metal of the main body is copper. As an alternative to copper, the metal main body can be constructed from a metallic material, in particular from a non-ferrous metal. The metal of the metal main body can have a high thermal conductivity. One example of the plastic of the plastic layer is polyimide, which is sold for example under the trade name Kapton®. Alternatively or additionally, all plastics known as thermoplastics and their modified variants, in particular the group of polyimides and/or parylenes and/or PTFE, can be used as plastic material for the plastic layer.

The plastic layer provides for a low electrical conductivity and a low sputtering sensitivity of the chamber wall, without reducing the high thermal conductivity of the main body.

In this case, an embodiment according in which the plastic layer covers the entire inner wall is particularly reliable with regard to avoiding debris formation. Alternatively, only those sections of the inner wall that have proved to be particularly susceptible with regard to debris formation or with regard to sputtering effects may be covered with the plastic layer.

The plastic layer can have a layer thickness that is in the range of between 3 μm and 500 μm. This represent an advantageous compromise with regard to production outlay, material properties and lifetime.

A metal layer can be disposed between the main body and the plastic layer. This can improve layer adhesion for the plastic layer on the main body. The metal layer can alternatively or additionally bring about an improvement in the thermal conductivity of the chamber wall. Material examples for such a metal layer or metal interlayer are gold, chromium, nickel, tin, silver, copper, ruthenium, silicon or molybdenum or some other metal suitable as coating material. A copper alloy or generally alloys composed of at least two of the abovementioned metals can also be used.

In some implementations, the metal layer covers the entire inner wall. This has the advantage of reliably avoiding debris formation. In some implementations, the metal layer has a layer thickness that is in the range of between 2 μm and 20 μm. This represent an advantageous compromise with regard to production outlay, material properties and lifetime.

In some implementations, it is useful to have a configuration of the main body in which the main body is embodied in a hollow-cylindrical fashion, and the plasma chamber is formed by a cylindrical inner cavity of the main body.

In accordance with a further aspect, the multilayer construction of the chamber wall has a main body and a plastic moulding insert arranged at least in sections on an inner wall of the main body facing the plasma chamber wall, and comprising at least one insert inner wall which serves as a lining of the chamber wall of the main body delimiting the plasma chamber and, for its part, delimits the plasma chamber. The advantages of such a plastic moulding insert correspond to those that have already been explained above with reference to the multilayer construction and particularly with reference to the plastic layer of the third aspect of the invention. One of the plastic materials explained above with reference to the plastic layer can be used as plastic material for the plastic moulding insert.

An axial length of the plastic moulding insert can significantly exceed an axial length of the main body. This can facilitate start-up of an EUV plasma light source equipped with such a source hollow body and have the consequence that the light source already immediately or shortly after start-up operates stably and homogeneously.

In some implementations, an EUV plasma light source includes a source hollow body described above. The advantages of the EUV plasma light source correspond to those that have already been explained above with reference to the source hollow body.

The advantages of the source hollow body according to the invention are manifested particularly well in the case of an EUV plasma light source that includes an induction plasma current generator. One variant of an EUV plasma light source comprising an induction plasma current generator is also known as "Z-pinch."Alternatively, the plasma can also be ignited between electrodes. One embodiment of such an EUV plasma light source is known for example from US 2011/0089834 A1. A magnetron plasma light source can be used as a further variant of the EUV plasma light source.

BRIEF DESCRIPTION OF DRAWINGS

Exemplary embodiments of the invention are explained in greater detail below with reference to the drawing. In said drawing.

DETAILED DESCRIPTION

Figure 1:
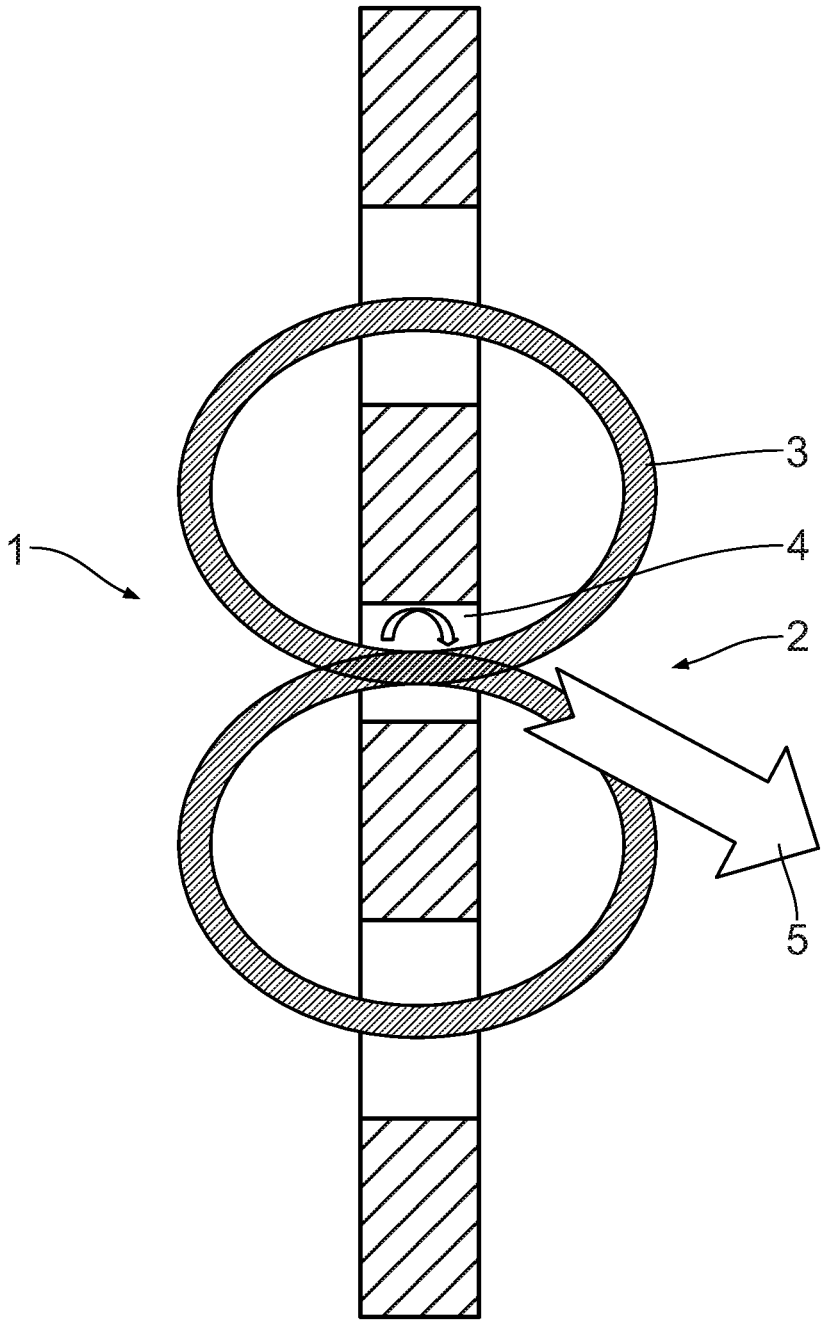
FIG. 1 shows highly schematically an EUV plasma light source comprising an induction plasma current generator.

FIG. 1 shows very highly schematically the principle of action of an embodiment of an EUV plasma light source 1 comprising an induction plasma stream generator 2. A noble gas plasma stream 3 constitutes a source plasma of the light source 1. A section of said source plasma 3 is present in a plasma chamber 4. The source plasma 3 within the plasma chamber 4 emits the EUV light 5. The principle of EUV light generation using such a light source 1 is described in the technical article "Extreme-ultraviolet light source development to enable pre-production mask inspection" by M. J. Partlow et al., J. Micro/Nanolith. MEMS MOEMS 11(2), 021105 (April-June 2012). The emitted EUV light 5 is the light that is actually useful for an illumination purpose. The plasma light source 1 includes devices to separate such useful light 5 from other emission contributions, e.g., from different wavelengths as compared to the useful light and/or from outside a dedicated plasma source emission area.

A source hollow body 6 explained in greater detail below with reference to FIGS. 2 and 3 serves for predefining the plasma chamber 4. The source hollow body 6 has a ceramic main body 7. The main body 7 is embodied in a hollow-cylindrical fashion. The plasma chamber 4 is formed by a cylindrical inner cavity of the ceramic main body 7.

In some implementations, the ceramic main body 7 is composed of silicon carbide (SiC). Alternatively, the main body 7 can be constructed from some other ceramic material, for example from an oxide ceramic or from a technical ceramic in the form of a boride, nitride or carbide. In a further variant, the main body 7 of the source hollow body 6 can be produced from metal, for example from copper or from some other non-ferrous metal or a corresponding alloy.

Figure 3:
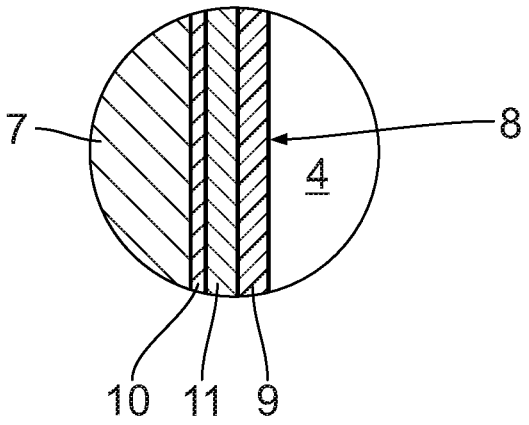
FIG. 3 shows an enlarged excerpt of the detail III in FIG. 2.

A chamber wall 8 of the source hollow body 6 that faces the plasma chamber 4 has a multilayer construction, which is illustrated in greater detail in FIG. 3. Said multilayer construction comprises an inner plastic layer 9 applied on an inner wall 10 of the ceramic main body 7 facing the plasma chamber 4. In this case, the plastic layer 9 can cover the entire inner wall 10. Alternatively, the plastic layer 9 can cover the inner wall 10 only in sections. In this case, the plastic layer 9 is applied in sections on the inner wall 10.

One example of the plastic material of the plastic layer 9 is polyimide (PI), which is sold for example under the trade name Kapton®. Alternatively or additionally, all plastics known as thermoplastics and their modified variants, in particular the group of polyimides and/or parylenes and/or PTFE, can be used as plastic material for the plastic layer 9.

The plastic layer 9 has a layer thickness that is in the range of between 3 μm and 500 μm, for example between 10 μm and 100 μm, and in particular between 20 μm and 50 μm. Generally, a layer thickness of the plastic layer 9 in the region for example of 3 μm, of 5 μm, of 10 μm, of 25 μm, of 50 μm, of 75 μm, of 100 μm, of 125 μm, of 150 μm, of 175 μm, of 200 μm, of 225 μm, of 250 μm, of 275 μm, of 300 μm, of 325 μm, of 350 μm, of 375 μm, of 400 μm, of 425 μm, of 450 μm, of 475 μm or of 500 μm are possible.

In an embodiment of the chamber wall 8 that is not illustrated, the plastic layer 9 is applied directly on the inner wall 10. In an alternative embodiment, illustrated in FIG. 3, a metal layer 11 is situated between the ceramic main body 7 and the plastic layer 9. During the production of the source hollow body 6, firstly the metal layer 11 is applied on the inner wall 10, followed by the plastic layer 9.

In some implementations, the metal layer 11 is composed of gold. Alternatively or additionally, one of the following metals can be used for the metal layer 11: chromium, nickel, tin, silver, copper, ruthenium, silicon or molybdenum. A copper alloy or generally alloys composed of at least two of the abovementioned metals can also be used.

As already explained above in connection with the plastic layer 9, the metal layer 11, too, can cover either the entire inner wall 10 or only at least one section of the inner wall 10. The metal layer 11 has a layer thickness that is in the range of between 2 μm and 20 μm, in particular in the range of between 5μm and 15 μm, and particularly in the region of 10 μm. The layer thickness of the metal layer 11 can be in the region of 2 μm, in the region of 4 μm, in the region of 6 μm, in the region of 8 μm, in the region of 10 μm, in the region of 12 μm, in the region of 14 μm, in the region of 16 μm, in the region of 18 μm, or in the region of 20 μm.

In the case of the source hollow body 6, the ceramic main body 7 provides for a high thermal conductivity. The plastic layer 9 provides for an insulation of the ceramic material from the plasma chamber 4 and leads to a low sputtering rate. The plastic layer 9 provides in particular for an electrical insulation.

Insofar as the layer construction of the chamber wall 8 including the metal layer 11 is used, the metal layer 11 firstly serves for improving layer adhesion between the plastic layer 9 and the inner wall 10 of the main body 7. Alternatively or additionally, the metal layer 11 provides for an improvement of the thermal conductivity of the chamber wall 8 of the source hollow body 6.

Figure 2:
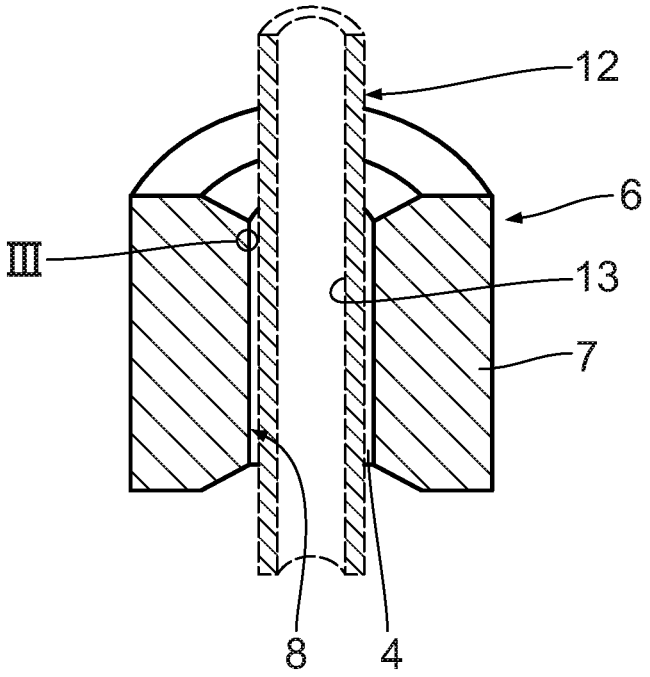
FIG. 2 shows, in a perspective axial section, a source hollow body for predefining a plasma chamber for a section of a source plasma of the plasma light source according to FIG. 1.

FIG. 2 illustrates using dashed lines a plastic moulding insert 12, which can be used instead of the plastic layer 9 in a further embodiment of the source hollow body 6. The plastic moulding insert 12 is embodied as a hollow-cylindrical or tubular insert, the external diameter of which is adapted with an accurate fit to the internal diameter of the chamber wall 8, such that the plastic moulding insert 12 is pushed into the main body 7 with a slight press-fit as part of the source hollow body 6. The plastic moulding insert 12 as part of the chamber wall 8 constitutes a lining thereof. The plastic moulding insert 12 is arranged on the inner wall 10 of the main body 7 facing the plasma chamber 4. An insert inner wall 13 of the plastic moulding insert 12 delimits the plasma chamber 4. The insert 12 can cover a complete inner side of the source hollow body 6 or alternatively also only sections of the latter.

As illustrated schematically in FIG. 2, an axial length of the plastic moulding insert 12 can significantly exceed the axial length of the main body 7.

Undesired formation of debris during the operation of the light source 1 is at least largely avoided in the case of the above embodiments of the source hollow body 6.

A number of embodiments of the source hollow body and EUV plasma light source have been described. Nevertheless, it will be understood that various modifications may be made without departing from the spirit and scope of the invention. It is to be understood that the foregoing description is intended to illustrate and not to limit the scope of the invention, which is defined by the scope of the appended claims.

What is claimed is:

1. A source hollow body for predefining a plasma chamber for a section of a source plasma of an EUV plasma light source, the hollow body comprising at least one chamber wall which delimits the plasma chamber, wherein the chamber wall comprises a multilayer construction, wherein the multilayer construction of the chamber wall comprises:

a main body; and a plastic layer applied at least in sections on an inner wall of the main body facing the plasma chamber.

2. The source hollow body according to claim 1, wherein the plastic layer covers the entire inner wall.

3. The source hollow body according to claim 1, wherein the plastic layer has a layer thickness that is in the range of between 3 μm and 500 μm.

4. The source hollow body according to claim 1, comprising a metal layer that is disposed between the main body and the plastic layer.

5. The source hollow body according to claim 4, wherein the metal layer covers the entire inner wall.

6. The source hollow body according to claim 4, wherein the metal layer has a layer thickness that is in the range of between 2 μm and 20 μm.

7. The source hollow body according to claim 1, wherein the main body is embodied in a hollow-cylindrical fashion, and the plasma chamber is formed by a cylindrical inner cavity of the main body.

8. An EUV plasma light source comprising a source hollow body according to claim 1.

9. The EUV plasma light source according to claim 8, comprising a metal layer that is disposed between the main body and the plastic layer.

10. The EUV plasma light source according to claim 8, comprising an induction plasma current generator.

11. The source hollow body according to claim 8, wherein the plastic layer covers the entire inner wall.

12. The EUV plasma light source according to claim 8, wherein the plastic layer has a layer thickness that is in the range of between 3 μm and 500 μm.

13. The EUV plasma light source according to claim 8, wherein the main body is embodied in a hollow-cylindrical fashion, and the plasma chamber is formed by a cylindrical inner cavity of the main body.

14. The EUV plasma light source according to claim 9, wherein the metal layer covers the entire inner wall.

15. The EUV plasma light source according to claim 9, wherein the metal layer has a layer thickness that is in the range of between 2 μm and 20 μm.

16. A source hollow body for predefining a plasma chamber for a section of a source plasma of an EUV plasma light source, the hollow body comprising at least one chamber wall which delimits the plasma chamber, wherein the chamber wall comprises a multilayer construction, wherein the multilayer construction of the chamber wall comprises:

a main body; and a plastic moulding insert arranged at least in sections on an inner wall of the main body facing the plasma chamber, and comprising at least one insert inner wall which serves as a lining of the chamber wall of the hollow body delimiting the plasma chamber and, for its part, delimits the plasma chamber.

17. An EUV plasma light source comprising a source hollow body according to claim 16.

18. The EUV plasma light source according to claim 17, comprising an induction plasma current generator.

19. The EUV plasma light source according to claim 17, wherein a metal layer is disposed between the main body and the plastic moulding insert.

20. The EUV plasma light source according to claim 19, wherein the metal layer covers the entire inner wall.

* * * * *